US007588477B2

(12) United States Patent
Sidwell

(10) Patent No.: US 7,588,477 B2
(45) Date of Patent: Sep. 15, 2009

(54) BALLOON ASSEMBLY

(75) Inventor: Paul E. Sidwell, Sanford, FL (US)

(73) Assignee: Maximum Visibility Solutions, LLC., Alachua, FL (US)

( * ) Notice: Subject to any disclaimer, the term of this patent is extended or adjusted under 35 U.S.C. 154(b) by 12 days.

(21) Appl. No.: 11/116,322

(22) Filed: Apr. 28, 2005

(65) Prior Publication Data

US 2006/0246816 A1 Nov. 2, 2006

(51) Int. Cl.
*A63H 3/06* (2006.01)

(52) U.S. Cl. ..... 446/224; 446/220

(58) Field of Classification Search ..... 446/220, 446/221, 222, 223, 224
See application file for complete search history.

(56) References Cited

U.S. PATENT DOCUMENTS

| | | | | |
|---|---|---|---|---|
| 2,882,645 | A | 4/1959 | Stivers | |
| 3,267,604 | A | 8/1966 | Goldsmith | |
| 3,428,319 | A * | 2/1969 | Engle | 273/393 |
| 4,589,854 | A * | 5/1986 | Smith | 446/223 |
| 4,737,133 | A | 4/1988 | Neumeier | |
| 4,895,545 | A * | 1/1990 | Nelson | 446/220 |
| 5,021,022 | A | 6/1991 | Ganz | |
| 5,203,530 | A * | 4/1993 | Liu | 248/309.1 |
| 5,395,276 | A | 3/1995 | Valentino | |
| D360,844 | S * | 8/1995 | Miller et al. | D10/110 |
| 5,444,607 | A | 8/1995 | Dreyfuss | |
| 5,944,576 | A * | 8/1999 | Nelson et al. | 446/220 |
| 6,176,758 | B1 | 1/2001 | Wu | |
| 6,575,806 | B1 | 6/2003 | Nelson et al. | |
| 6,969,295 | B1 * | 11/2005 | Sidwell | 446/220 |

FOREIGN PATENT DOCUMENTS

| | | |
|---|---|---|
| EP | 105179 | 4/1984 |
| WO | 9105592 | 5/1991 |

* cited by examiner

*Primary Examiner*—Nini Legesse
(74) *Attorney, Agent, or Firm*—Saliwanchik, Lloyd & Saliwanchik

(57) ABSTRACT

A balloon assembly including a pedestal portion having a mounting bracket for attachment to an upright support. A rod projects upwardly from the mounting bracket and carries a cup at its top with a pair of opposed slots. An inflatable portion is releasably connected to the pedestal portion and has an air-filled bladder to the bottom of which a cap is affixed. The cap is adapted for positioning within the cup and has a pair of resilient tabs extending downwardly therefrom for positioning within the slots in the cup. Each of the tabs has an outwardly projecting shoulder for releasably catching upon the cup.

17 Claims, 3 Drawing Sheets

BALLOON ASSEMBLY

FIELD OF THE INVENTION

The present invention relates generally to amusement devices and, more particularly, to inflatable toys.

BACKGROUND OF THE INVENTION

Automobile dealers frequently tie helium-filled balloons to cars that they are offering for sale to attract the interest of passersby and to generate a festive atmosphere for conducting business. Unfortunately, helium-filled balloons leak over time and sag to the ground, producing a less than cheerful impression in potential car buyers. Automobile dealers, therefore, must frequently replace balloons—a costly undertaking since neither manpower nor helium is inexpensive.

SUMMARY OF THE INVENTION

In light of the problems associated with the constant replacement of balloons by automobile dealers seeking to attract buyers onto their lots, it is a principal object of the invention to provide a balloon assembly that simulates the look of a helium-filled balloon on a string but which requires minimal maintenance. Since the assembly is not appreciably affected by typical periods of wind, rain, or snow, it can be employed year-round.

It is an additional object of the invention to provide a balloon assembly of the type described that can support either a durable, air-filled bladder resembling a balloon or a conventional, air-filled balloon at a fixed height above a support. Both the bladder and the balloon can be detached from the balance of the assembly for the purposes of storage, inflation and replacement.

It is an object of the invention to provide a balloon assembly for the purposes described that is lightweight in construction, inexpensive to manufacture, and fully dependable in use.

Briefly, the balloon assembly achieves the intended objects by featuring pedestal and inflatable portions that can be easily attached to, and detached from, one another. In use, the pedestal portion is secured atop an automobile window and the inflatable portion is clipped atop the pedestal portion—a process requiring mere seconds to complete. (Detachment is just as fast.) So, in the event of an impending storm of a severe nature, or prior to occasions when an automobile dealership will be closed for prolonged periods, the inflatable portion can be gathered up to prevent their potential loss and stored in a secure place for reuse at a later time.

The balloon assembly also features an inflatable portion having a bladder that can be easily filled with air rather than expensive helium. The pedestal portion, being relatively rigid, prevents the inflatable portion from sagging to the ground in the manner of a leaky helium-filled balloon. Thus, the balloon assembly reduces the need for an automobile dealer to replace balloons about his property.

Further, the balloon assembly features an inflatable portion having a bladder that is not easily popped. The bladder is formed, in part, from a heavy-gauge vinyl sheeting that is not prone to tears or punctures. This material has a useful life that is many times that of the thin rubber employed in conventional balloons.

The balloon assembly of the type described that features an inflatable portion having a bladder with a nozzle that admits air by way of a user's mouth or mechanical pump. A user can fill one or one hundred balloons with equal ease.

It is another object of the invention to provide a balloon assembly of the type described that can be set up with minimal instruction and without resort to any tools. The balloon assembly is intuitive to use.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
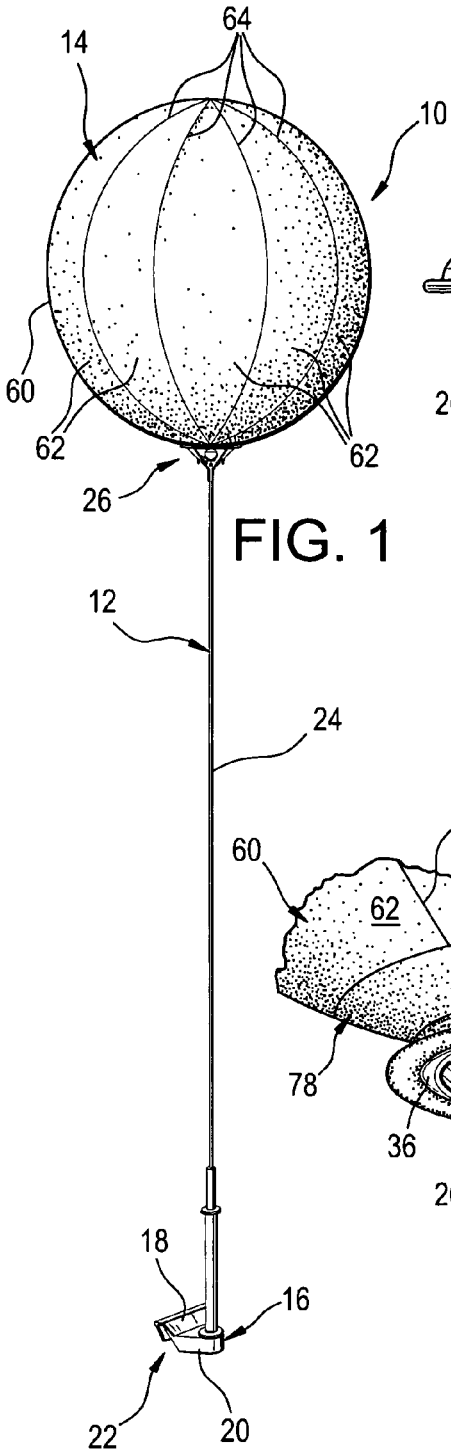
FIG. 1 is a perspective view of a balloon assembly in accordance with the present invention.
Figure 2:
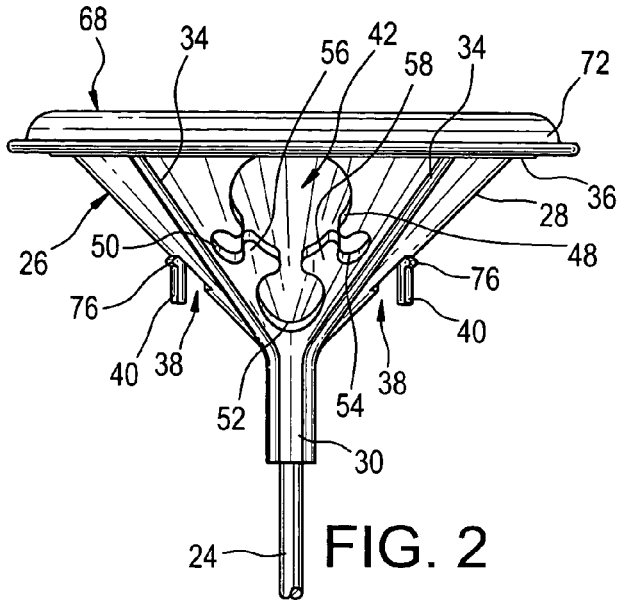
FIG. 2 is a front view of a cup and a cap shown mated together. The cup and cap are upper parts of the assembly of FIG. 1 and connect the pedestal portion and inflatable portion of the balloon assembly together.
Figure 3:
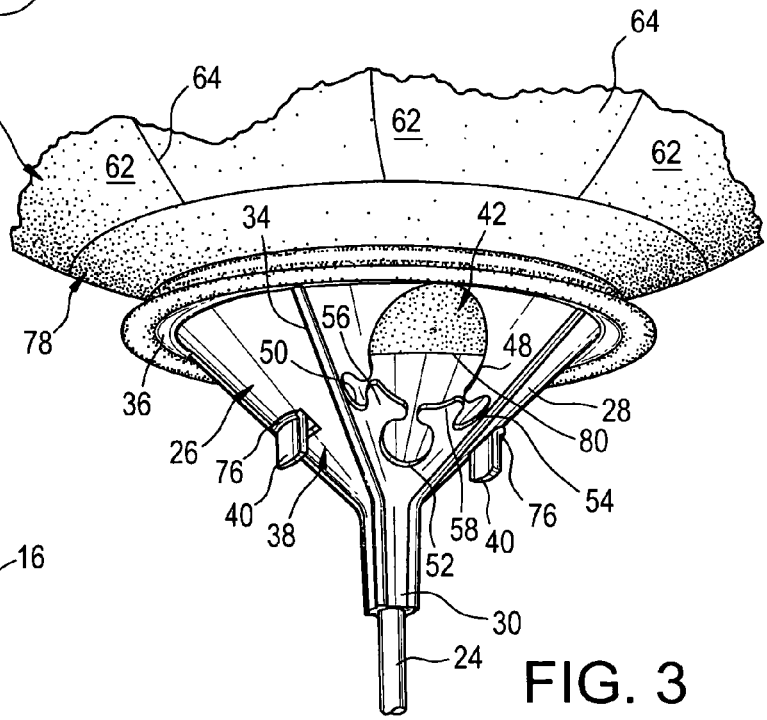
FIG. 3 is a perspective view of the connection between the pedestal portion and inflatable portion of the balloon assembly.
Figure 4:
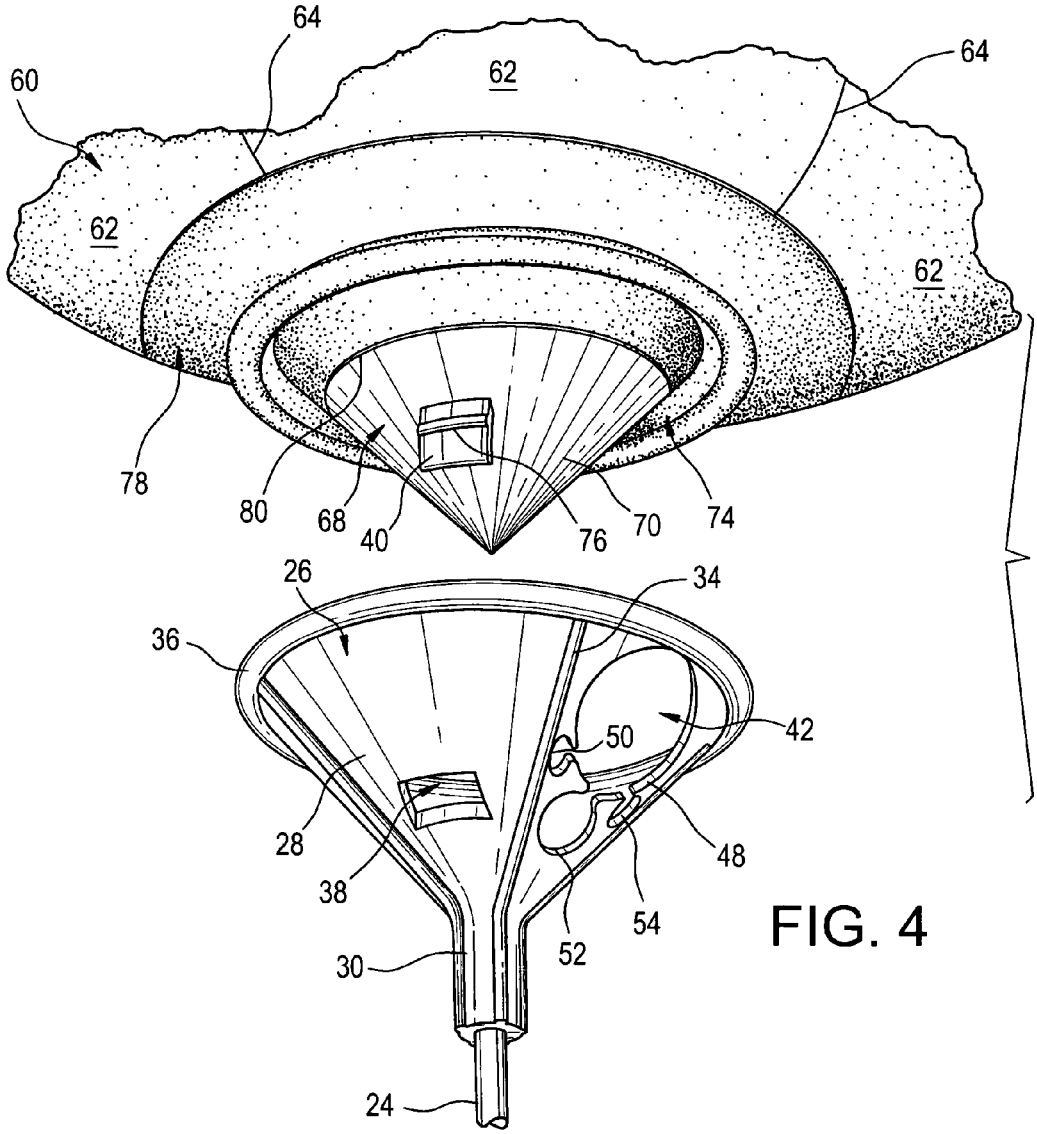
FIG. 4 is an perspective view of the top of the pedestal portion and the bottom of the disconnected, inflatable portion.
Figure 5:
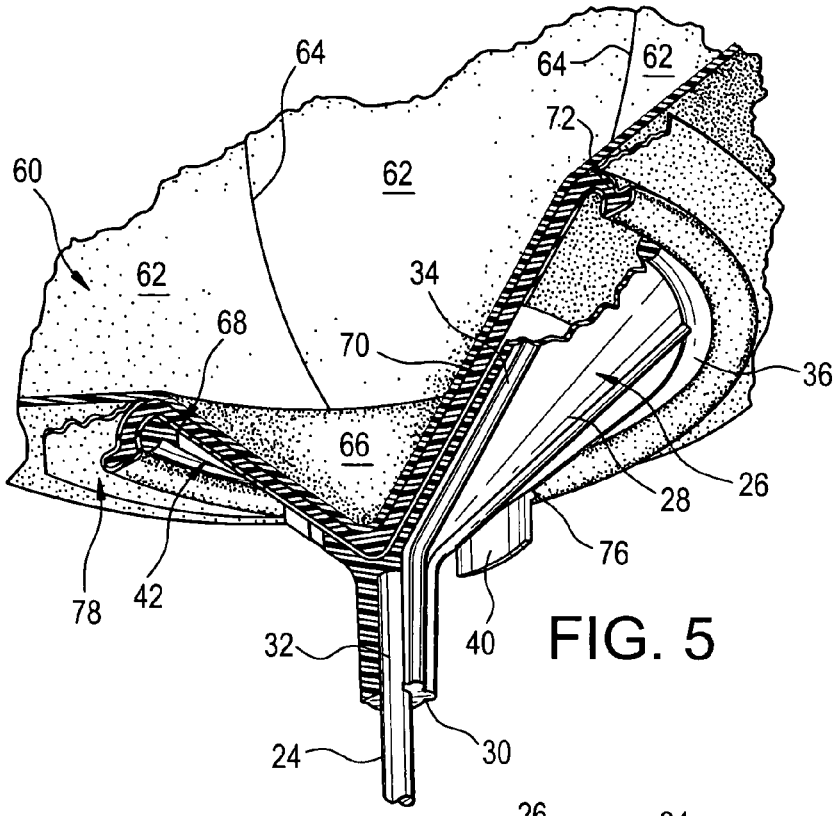
FIG. 5 is a perspective view of the connection between the pedestal portion and the inflatable portion with parts of the pedestal portion and inflatable portion being removed to reveal details thereof.

Referring now to the FIGS., a balloon assembly in accordance with the present invention is shown at 10. Assembly 10 includes a pedestal portion 12 that is attachable to an upright support such as an automobile window (not shown). An inflatable portion 14 is fastened to pedestal portion 12. Together, pedestal portion 12 and inflatable portion 14 effectively simulate the look of a helium-filled balloon yet lack its drawbacks.

Pedestal portion 12 includes a mounting bracket 16 adapted for attachment to the top of a support. Bracket 16 includes a hook 18 resembling an inverted "L" extending from a block 20. Between hook 18 and block 20 is a downwardly opening slot 22 for snugly receiving the top of window or other supporting surface (not shown).

A flexible rod 24 projects upwardly from mounting bracket 16. For the sake of simplicity, the bottom of rod 24 is shown as being permanently affixed to block 20. Nonetheless, it must be appreciated that rod 24 can be made removable from mounting bracket 16. One manner of making rod 24 removable from block 20 is illustrated in my co-pending utility patent application Ser. No. 10/838,257, incorporated by reference for all purposes herein.

Rod 24 is formed of carbon fiber composite, fiberglass, plastic, aluminum or any other suitable material. Rod 24 is provided with dimensions adequate to simulate the string that is typically tied to a helium-filled balloon employed as a toy. It is expected that rod 24 would likely measure about one meter in length and a few millimeters in diameter. With such dimensions, rod 24 will sway from side-to-side in light breezes, shoring up the illusion that balloon assembly 10 is, in fact, a helium-filled balloon on a string.

A cup 26 is affixed to the top of rod 24. Cup 26 has a conical side wall 28 that tapers in diameter to a narrowed bottom from which a stem 30 extends downwardly to receive the top of rod 24 in a socket 32 positioned therein. Side wall 28 and stem 30 are reinforced about their sides by a number of spaced-apart ribs 34 that extend downwardly from the top of side wall 28 to the bottom of stem 30. Side wall 28 is further reinforced about its top by an enlarged lip 36. Lip 36 has a sufficient size to receive the bottom of inflatable portion 14 and hold inflatable portion 14 upright in normal weather conditions.

Side wall 28 is provided with a pair of opposed slots 38 for receiving a pair of tabs 40 of corresponding size that project downwardly from inflatable portion 14. Slots 38 are rectangular in outline, their tops being substantially parallel to lip 36. So as to not weaken cup 26, slots 38 are positioned between ribs 34.

Located between a pair of ribs 34 remote from slots 38 is an aperture 42 for receiving the nozzle 44 of a conventional, air-filled balloon 46. Aperture 42 includes a principal lobe 48 having a relatively large size and three, smaller, secondary lobes 50, 52 and 54 that branch from principal lobe 48. Secondary lobes 50, 52 and 54 are separated by a pair of T-shaped fingers 56 and 58 upon which nozzle 44 can be wound to secure an air-filled balloon 46 to pedestal portion 12 and prevent the deflation of balloon 46 while sitting atop cup 26.

Stem 30 is a cylinder with a longitudinal socket 32 for receiving the top of rod 24. The length and diameter of stem 30 are adequate to provide a strong connection between cup 26 and rod 24 and withstand expected wind loads on either inflatable portion 14 or balloon 46. Stem 30 is preferably integrally formed with side wall 28 but, if desired, can be separately made and fastened with adhesives or other suitable means to the bottom of side wall 28.

Inflatable portion 14 includes an air-filled bladder 60 resembling, in terms of appearance, a helium-filled balloon. Bladder 60 is constructed in the manner of a manually inflated beach ball and is made up of a number of vinyl panels 62 joined side-by-side by impermeable seams 64. Unlike a beach ball, however, one or more of panels 62 define a conical projection 66 at the bottom of bladder 60 that is sized for positioning within cup 26.

A cap 68 is fitted over projection 66. Cap 68 includes a conical side wall 70 dimensioned for snug positioning within cup 26. Side wall 70 tapers in diameter from its top to a point at its bottom. Side wall 70 is reinforced about its top by a downwardly projecting rim 72 that defines an annular recess 74 around side wall 70. Lip 36 can be fitted into recess 74 when inflatable portion 14 is pressed downwardly onto pedestal portion 12 to provide a strong connection between portions 12 and 14 capable of withstanding maximum wind loadings.

Tabs 40 extend downwardly from opposite sides of side wall 70 for positioning within slots 38 in cup 26. Proximate their midpoints, tabs 40 have outwardly projecting shoulders 76 that catch upon side wall 28 at the tops of slots 38 when cup 26 and cap 68 are mated together. Since tabs 40 are integrally formed with side wall 70 and rim 72 from a resilient material, shoulders 76 can be selectively disengaged from side wall 28 simply by squeezing the free ends of tabs 40. With shoulders 76 disengaged from side wall 28, cup 26 and cap 68 can, of course, be easily disengaged from one another.

A retaining ring 78, preferably formed of the same vinyl sheet material from which panels 62 are cut but possibly formed from another suitable material, holds cap 68 over conical projection 66. As shown, ring 78 is provided with an outer diameter that is somewhat greater than that of projection 66 so that rim 72 can be positioned between projection 66 and the periphery of ring 78. Furthermore, the opening 80 provided at the center of ring 78 is carefully sized and is large enough for the bottom of cap 68 and tabs 40 to project downwardly through it yet is sufficiently small so as to prevent the passage of rim 72.

Retaining ring 78 is secured to bladder 60 and cap 68 by any suitable means. These means may include the application of heat and pressure to ensure that the surface contours of ring 78 in the finished inflatable portion 14 closely follow those of cap 68.

The use of balloon assembly 10 is straightforward. First, pedestal portion 12 and inflatable portion 14 are connected by pressing cap 68 into cup 26 while making sure that tabs 40 are aligned with slots 38. After shoulders 76 of tabs 40 "snap" into place against conical side wall 28 of cup 26, hook 18 is engaged with a support like the top of an automobile window. Finally, the window is closed against its seal, either by rolling up the window or closing the automobile door of which window forms a part, locking assembly 10 locked in place. Passersby are likely to obtain a favorable impression of both the automobile supporting assembly 10 and the owner of the automobile.

Should foul weather threaten, inflatable portion 14 can be detached from pedestal portion 12, leaving pedestal portion 12 in place. To do this, a user need only squeeze tabs 40 together to release shoulders 76 from conical side wall 28 of cup 26 and, then, push upwardly on tabs 40. Inflatable portion 14 can now be moved to a secure place for later reuse. The light weight and small size of inflatable portion 14 permits it to be transported and stored practically anywhere.

To enhance the attractiveness of inflatable portion 14, panels 62 may be provided with bright and contrasting colors. Furthermore, panels 62 can be provided with printed indicia in the form of logos, slogans, trademarks, advertisements and artworks of various sorts. If panels 62 are formed of a transparent material, it is contemplated that advertising displays or toys could be secured inside bladder 60 completely shielded from the weather.

Figure 6:
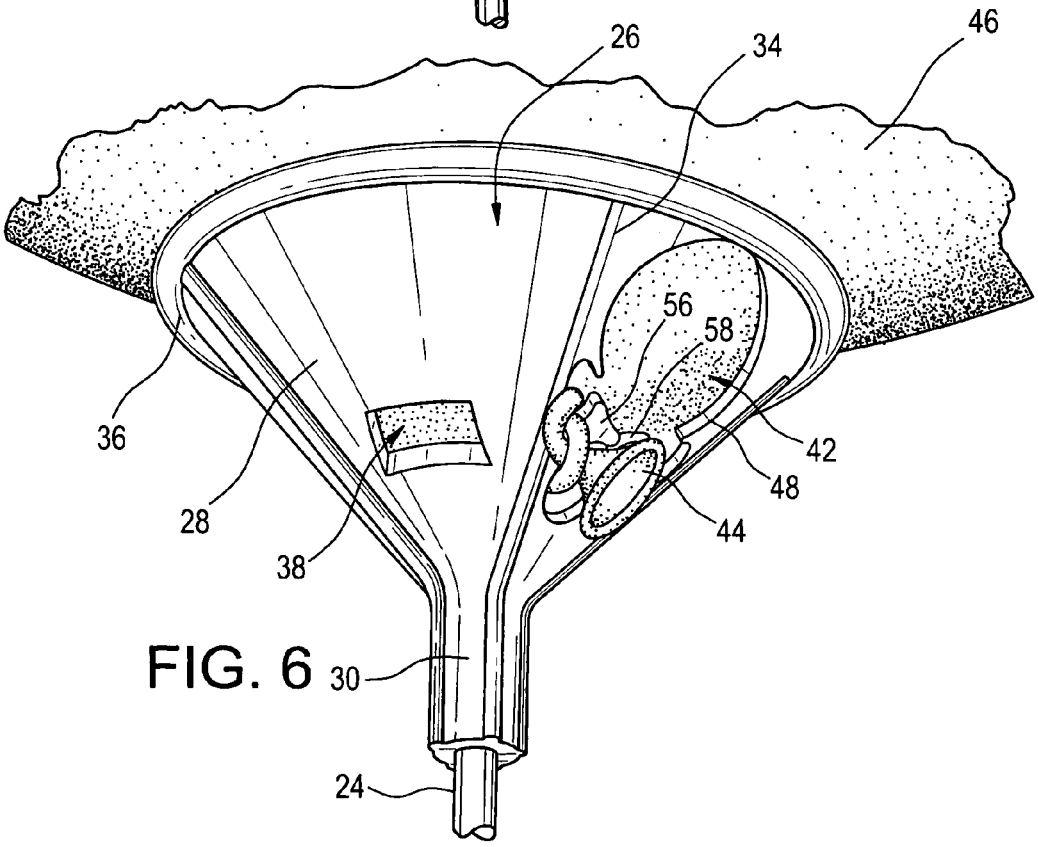
FIG. 6 is a perspective view of the pedestal portion carrying a conventional, air-filled balloon.

A user can employ pedestal portion 12 with a conventional air-filled balloon 46 rather than inflatable portion 14 if he so desires. To accomplish this, air-filled balloon 46 is first secured to cup 26 by extending nozzle 44 downwardly through principal lobe 48 of aperture 42. Then, nozzle 44 is pulled into one of the secondary lobes 50, 52 or 54 of aperture 42 and is wound around one or both of fingers 56 and 58 as illustrated in FIG. 6. Next, hook 18 is clasped upon the top of a support. From a distance, air-filled balloon effectively mimics a helium-filled balloon but possesses few of its drawbacks.

While balloon assembly 10 has been described with a high degree of particularity, it will be appreciated by those skilled in the art that modifications can be made to it. Therefore, it is to be understood that the present invention is not strictly limited to the balloon assembly described above, but encompasses any and all products within the scope of the following claims.

I claim:

1. A balloon assembly, comprising:

a pedestal portion including:

a mounting bracket;

a rod projecting upwardly from said mounting bracket; and, a cup being secured atop a first end of said rod for carrying an air-filled bladder or an air-filled balloon, said cup being provided with an aperture, for receiving the nozzle of a balloon, being bounded in part by a finger upon which the nozzle can be tied;

wherein said mounting bracket is connected to a second end of said rod located opposite from said first end; and wherein said cup further comprises a pair of spaced-apart slots remote from said aperture; and wherein said assembly further comprises an inflatable portion including:

an air-filled bladder; and, a cap being secured to the bottom of said air-filled bladder and being adapted for positioning within said cup, said cap having a pair of resilient tabs for positioning within said slots and releasable securement to said cup.

2. The balloon assembly according to claim 1 wherein said cap further includes a conical side wall and a rim that projects downwardly from the top of said conical side wall to define an annular recess for receiving the top of said cup when said pedestal portion and said inflatable portion are connected together.

3. The balloon assembly according to claim 2, wherein said mounting bracket is adapted to mount said balloon assembly to an automobile.

4. The balloon assembly according to claim 3, wherein said mounting bracket is adapted to mount said balloon assembly to an automobile window.

5. The balloon assembly according to claim 1 wherein each of said tabs is provided with an outwardly projecting shoulder for catching upon a side wall of said cup when said tabs are positioned within said slots.

6. The balloon assembly according to claim 1, wherein said mounting bracket is adapted to mount said balloon assembly to an automobile.

7. The balloon assembly according to claim 6, wherein said mounting bracket is adapted to mount said balloon assembly to an automobile window.

8. A balloon assembly, comprising:

a pedestal portion including:

a mounting bracket;

a rod projecting from said mounting bracket; and, a cup being affixed to the free end of said rod and comprising a pair of opposed slots; and an inflatable portion being releasably connected to said pedestal portion, said portion including:

an air-filled bladder; and, a cap being affixed to said air-filled bladder and being adapted for positioning within said cup, said cap comprising a pair of resilient tabs with outwardly projecting shoulders for positioning within said slots and releasably catching upon said cup.

9. The balloon assembly according to claim 8 wherein said cup is provided with an aperture remote from said slots for receiving the nozzle of a balloon, said aperture being bounded in part by a pair of T-shaped fingers upon which the nozzle of a balloon can be tied.

10. The balloon assembly according to claim 8 wherein said cap further includes a conical side wall and a rim that projects downwardly from the top of said conical side wall to define an annular recess for receiving the top of said cup when said pedestal portion and said inflatable portion are connected together.

11. The balloon assembly according to claim 8 wherein said cap is affixed to said air-filled bladder by means of a ring of resilient sheeting affixed to said air-filled bladder and encircling said cap.

12. The balloon assembly according to claim 8, wherein said mounting bracket is adapted to mount said balloon assembly to an automobile.

13. The balloon assembly according to claim 12, wherein said mounting bracket is adapted to mount said balloon assembly to an automobile window.

14. A balloon assembly, comprising:

a pedestal portion including:

a mounting bracket having a hook for attachment to the top of an upright support;

a rod projecting upwardly from said mounting bracket; and, a cup being affixed to the top of said rod and having a first conical side wall and a pair of opposed slots in said first conical side wall; and, an inflatable portion being releasably connected to said pedestal portion, said inflatable portion including:

an air-filled bladder; and, a cap being affixed to the bottom of said air-filled bladder and being adapted for positioning within said cup, said cap having a second conical side wall and pair of resilient tabs extending downwardly from said second conical side wall for positioning within said slots, and each of said tabs having an outwardly projecting shoulder for releasably catching upon said first conical side wall when said cap is positioned within said cup.

15. The balloon assembly according to claim 14 wherein said cup is provided with an aperture remote from said slots for receiving the nozzle of a balloon, said aperture being bounded in part by a pair of T-shaped fingers upon which the nozzle of a balloon can be tied.

16. The balloon assembly according to claim 14 wherein said cap includes a downwardly projecting rim about the top of said second conical side wall that defines an annular recess between itself and said second conical side wall and said cup further includes an enlarged lip about the top of said first conical side wall adapted for positioning within said annular recess.

17. The balloon assembly according to claim 16 wherein said cap is affixed to said air-filled bladder by means of a ring of resilient sheeting affixed to said air-filled bladder and encircling said cap, said ring engaging said downwardly projecting rim and said second conical side wall and entering said annular recess.

* * * * *